US006820754B2

(12) United States Patent
Ondrasik

(10) Patent No.: US 6,820,754 B2
(45) Date of Patent: Nov. 23, 2004

(54) PRODUCT FEED APPARATUS AND METHOD FOR SHELF UNIT

(75) Inventor: V. John Ondrasik, Los Angeles, CA (US)

(73) Assignee: Precision Wire Racks & Carts, Inc., Commerce, CA (US)

( * ) Notice: Subject to any disclaimer, the term of this patent is extended or adjusted under 35 U.S.C. 154(b) by 16 days.

(21) Appl. No.: 10/263,854

(22) Filed: Oct. 3, 2002

(65) Prior Publication Data

US 2004/0065630 A1 Apr. 8, 2004

(51) Int. Cl.[7] ..... A47F 5/00
(52) U.S. Cl. ..... 211/59.3; 312/71
(58) Field of Search ..... 211/59.3, 51; 312/61, 312/71

(56) References Cited

U.S. PATENT DOCUMENTS

| | | | | |
|---|---|---|---|---|
| 3,083,067 A | | 3/1963 | Vos et al. | |
| 4,706,821 A | | 11/1987 | Kohls et al. | |
| 4,836,390 A | * | 6/1989 | Polvere | 211/59.3 |
| 4,901,869 A | | 2/1990 | Hawkinson et al. | |
| 5,111,942 A | | 5/1992 | Bernardin | |
| 5,190,186 A | * | 3/1993 | Yablans et al. | |
| 5,265,738 A | | 11/1993 | Yablans et al. | |
| 5,605,237 A | | 2/1997 | Richardson et al. | |
| 5,839,588 A | | 11/1998 | Hawkinson | |
| 6,381,966 B1 | | 5/2002 | Barrow | |
| 6,409,027 B1 | * | 6/2002 | Chang et al. | 211/59.3 |
| 6,464,089 B1 | * | 10/2002 | Rankin | 211/59.3 |
| 6,527,127 B2 | * | 3/2003 | Dumontet | 211/59.3 |
| 6,622,874 B1 | * | 9/2003 | Hawkinson | 211/59.3 |
| 6,655,536 B2 | * | 12/2003 | Jo et al. | 211/59.3 |

FOREIGN PATENT DOCUMENTS

DE 003211880 A1 10/1983

* cited by examiner

*Primary Examiner*—Robert W. Gibson, Jr.
(74) *Attorney, Agent, or Firm*—Gordon & Rees LLP

(57) ABSTRACT

A product feed apparatus for feeding a row of products towards the front edge of a shelf has an elongate track mounted on the shelf so as to extend from a rear edge to the front edge of the shelf. A pusher member is slidably mounted in the track for engaging the rearmost product of a row of products supported on the track, and a biasing mechanism biases the pusher member towards the front edge of the track so as to advance product to the front edge of the shelf. The biasing mechanism includes a plurality of identical elongate, resilient biasing elements which can be releasably secured between the front end of the pusher member and the track so as to move the pusher member along the track. The user selects the number of biasing elements to be used based on the size and weight of product to be advanced.

23 Claims, 3 Drawing Sheets

PRODUCT FEED APPARATUS AND METHOD FOR SHELF UNIT

BACKGROUND OF THE INVENTION

The present invention relates generally to a product feed or dispensing apparatus and method for feeding product arranged in rows to the front edge of display shelf, so that it may be retrieved by a customer.

Products in various types of stores are commonly stored on display shelves in adjacent rows so that customers can readily see the different products, and retrieve a product conveniently for purchase. In grocery stores, refrigerated cabinets containing shelf units are provided for perishable foodstuffs, and drinks such as sodas, milk, juice and the like, with glass cabinet doors to allow customers to see the products. Cans of different types of sodas are typically arranged on such shelves in adjacent rows. However, there is a problem in feeding the product to the front of the shelf when the front item, such as a can, has been removed by the customer.

In some cases, shelves are inclined downwardly from the rear to the front end, so that products can be gravity fed to the front of the shelf. This has some disadvantages, however, since products sometimes do not slide smoothly down the shelf and can fall over, jamming the row from feeding properly. Also, customers cannot see the products on lower shelves when they are inclined downwardly. Products are more visible when the shelves are horizontal, and even more visible on the lower shelves if the shelves are inclined upwardly from the rear edge to the forward edge. However, some drive mechanism or pusher arrangement must then be provided in each row to feed product to the front of the shelf.

Various prior product feed mechanisms have been devised for grocery store shelves. In most cases, a spring loaded pusher is provided for each row of products. However, it is difficult to adjust such systems for products of different sizes and weights. Also, loading of an empty shelf can be difficult, since the operator must physically hold the pusher at the rear of the shelf while filling each row. If they accidentally release it before the shelf is filled, product may be impelled to the front of the shelf at high speed, potentially being pushed off the front edge of the shelf. Some prior art product feed mechanisms of this general type are described in U.S. Pat. No. 5,605,237 of Richardson et al., U.S. Pat. No. 5,111,942 of Bernardin, and U.S. Pat. No. 4,901,869 of Hawkinson, for example.

SUMMARY OF THE INVENTION

It is an object of the present invention to provide a new and improved product feed apparatus and method for product display and dispensing shelves in grocery stores and the like.

According to one aspect of the present invention, a product feed apparatus for feeding products or items arranged in rows on a shelf to the front edge of the shelf is provided, which comprises an elongate track adapted to be mounted on a rectangular shelf unit so as to extend from a rear edge to a front edge of the shelf unit, the track having opposite sides, a forward end, and a rear end, a pusher member slidably mounted in the track for movement from the rear edge to the front edge of the track, the pusher member having a front end, a pusher plate for engaging a rear surface of the rearmost product of a row of products supported on the track, and a biasing assembly for biasing the pusher member towards the front edge of the track, the biasing assembly comprising a plurality of identical, elongate spring or biasing elements for selectively securing to the pusher member to extend from the pusher member to an anchor on the track. In an exemplary embodiment, the biasing assembly may include a pair of rollers mounted side by side adjacent the front edge of the track, each roller having at least two circumferential grooves, a first anchor at the front end of the pusher member, and at least one second anchor positioned adjacent the rear end of on each side of the track. Each resilient element extends from the pusher member around a respective one of the rollers and then rearwardly along a respective side of the track back to a respective second anchor. Each biasing element engages in a respective groove in a roller, whereby an operator can adjust the spring force applied to the pusher member by varying the number of biasing elements in the biasing assembly by selectively extending a greater or lesser number of biasing elements from the pusher member, around a respective roller, and up to a respective second anchor.

If the rollers each have two grooves for receiving up to two biasing elements, then the operator can choose to mount zero, one, or two biasing elements on each side of the track, so that any number of biasing elements from one to four may be used. A greater number of grooves may be provided for further increase in the biasing force. The biasing elements may be linear tension, rope type springs. Thus, rather than providing a number of different size springs having different spring constants, which would be more expensive and require the operator to test the pusher member with various different springs to determine the optimum spring constant for each product, the operator does not have to select between different springs in this arrangement, but simply adds or removes identical springs until an optimum advancing force is provided.

According to another aspect of the present invention, the pusher member has a spring loaded latch element movable between a raised position and a downwardly extending, locking position, the spring biasing the latch element into the locking position. The track has a base having a series of holes, and the latch element engages in one of the holes when in the locking position. When products are loaded in a row in front of the pusher member, the rearmost product will force the latch element into the raised position, allowing the pusher member to advance along the track. With this arrangement, the operator does not have to hold the pusher member at the rear end of the track initially when it is pushed back after all product has been emptied from the track. Instead, it will be automatically locked in this position when no product is present. Also, if the operator accidentally lets go of the pusher member while retracting it, it will not suddenly shoot or fly forward along the track, but will be locked in position where it is released.

The track is adapted to be arranged side-by-side on a shelf unit adjacent other, identical tracks, so that plural rows of different products can be loaded across the entire width of the shelf unit. Dividers may be mounted on the shelf on opposite sides of the track, to separate the row of product on that track from adjacent rows. Alternatively, for wider products such as six packs of soda, gallon size containers of milk and other beverages, pizza boxes, and the like, two or more tracks may be mounted side by side with dividers on the outer sides of the outermost tracks only, with two or more pusher members acting on the rearmost product to push it forwards. This also provides additional pushing force and a more uniform distribution of force across the width of the product.

The pusher plates may be releasably engaged on the pusher member, so that different size and shape pusher plates may be used, depending on the shape and size of product to be advanced. The latch member has a portion which protrudes forwardly from the pusher plate when in the locked position, so as to be pushed rearwardly as the product is loaded onto the track, simultaneously lifting the latch member from the track and into the raised position, allowing the pusher member to urge the row of products forwards when an item is retrieved from the front of the shelf unit.

According to another aspect of the present invention, a method of feeding a row of products towards the front edge of a shelf is provided, which comprises the steps of:

mounting at least one elongate track on a shelf so as to extend from the rear edge to the front edge of the shelf;

retracting a spring-loaded pusher member slidably mounted on the track to a rear end of the track;

locking the pusher member in the retracted position with a latch member against a spring force urging it towards the front edge of the shelf;

loading a row of products onto the track in front of the pusher member, the latch member being automatically released by the loading of products; and biasing the pusher member towards the front edge of the shelf, whereby the row of products is advanced to the front edge each time a product is removed from the front of the row.

The method may include varying the number of springs attached to the pusher member so as to change the biasing force on the pusher member dependent on the size and weight of product to be advanced. Also, two or more tracks may be mounted side by side and a single row of larger products may be loaded onto the adjacent tracks, with the pusher members on all the tracks acting against the rearmost product in the row.

The product feed apparatus and method of this invention will reliably feed products to the front edge of a shelf in a grocery store or the like, with the shelves being arranged horizontally or inclined upwardly. The number of springs used can be readily adjusted to provide a greater or lesser spring force on the pusher member, depending on the size and weight of product to be advanced. The tracks can be readily mounted side by side without separating walls or dividers, so that two or more tracks support a single row of larger products. This apparatus is therefore readily adaptable for products of various sizes, weights, and shapes.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
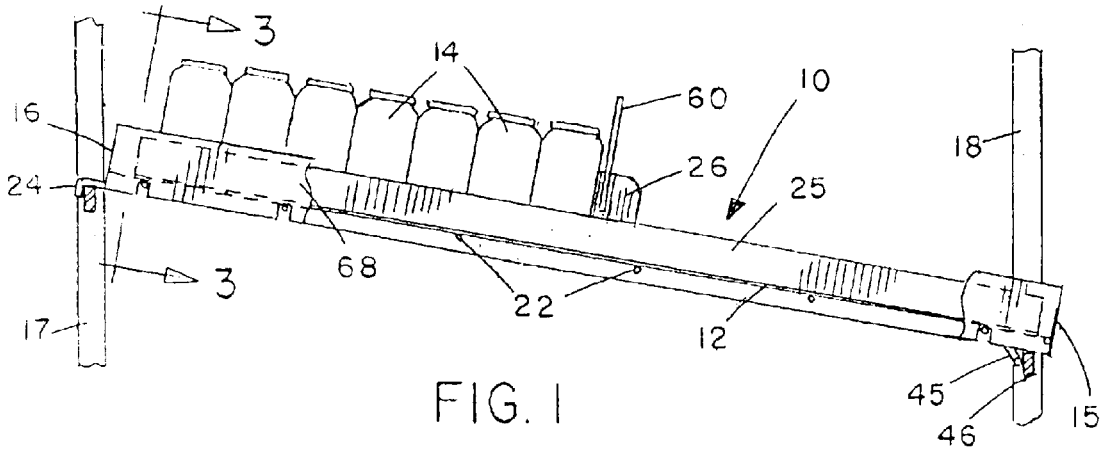
FIG. 1 is a side view of a shelf mounted in a supporting frame, illustrating a product feed apparatus according to an exemplary embodiment of the invention for feeding a row of product towards the front of the shelf.

The drawings illustrate a product feed apparatus 10 according to an exemplary embodiment of the invention mounted on a typical shelf 12 of a shelf system in a grocery store or the like. It will be understood that, although only one feed apparatus 10 is shown on the shelf 12 in FIGS. 1 to 7, in practice a plurality of such mechanisms will be mounted side-by-side across the entire width of the shelf. The feed apparatus 10 feeds a row of products 14 such as canned goods, soda cans, or other containers, from the rear edge 15 towards the front edge 16 of the shelf, which may be inclined upwardly as illustrated in FIG. 1, or may be oriented at other angles, including horizontal.

Figure 2:
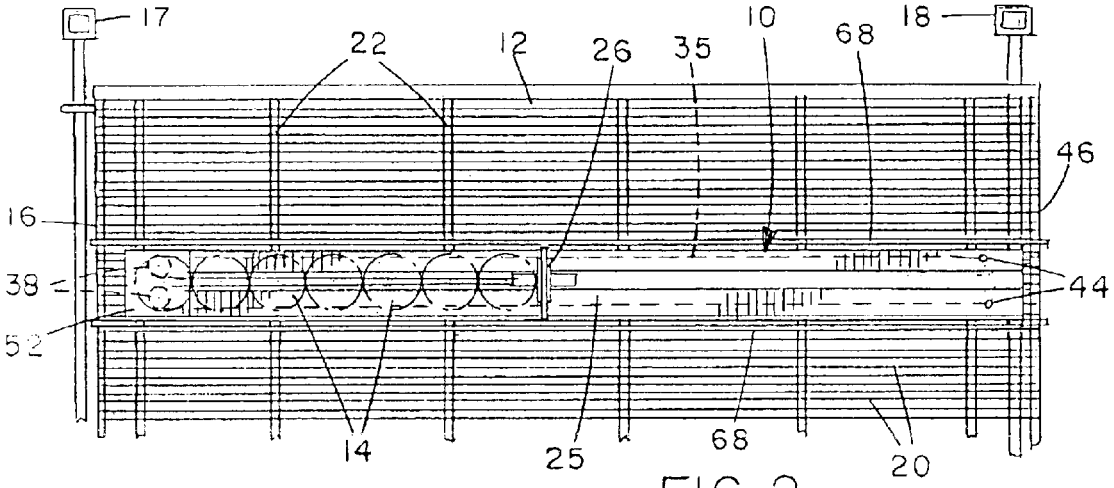
FIG. 2 is a top view of the shelf structure with a single product feed apparatus mounted on the shelf.

In typical store display shelving systems, a stack of shelves 12 are mounted on a supporting frame, which may have posts 17,18 arranged to support the stack of shelves, as indicated in FIGS. 1 and 2. The shelf 12 may be of any standard construction. In the illustrated embodiment, the shelf is of grill-like construction, with a peripheral frame, a series of spaced, parallel plastic or metal wires 20 running from the rear edge to the front edge of the frame, and a series of transverse, supporting rods 22 running between the sides of the frame beneath wires 20. However, other shelf constructions, such as solid panel shelves, may alternatively be used with the feed system of this invention. In the illustrated embodiment, the rear end of the shelf is pivoted to the rear posts 18 of the frame, while the front corners have hooks 24 which engage through a selected opening in the front posts 17. The front hooks 24 may be selectively hooked through different openings to adjust the shelf inclination. In alternative arrangements, the posts 17 may be positioned at the sides of the shelf, with hooks provided on the shelf sides to engage the posts. In the upwardly inclined orientation of FIG. 1, it will be easy for customers to view the products at the front of each row on the lowermost shelves of a stack of shelves mounted on support posts 17,18.

Products such as cans 14 are typically arranged on shelves 12 in adjacent rows, usually with a divider between each row. The feed apparatus 10 of this invention is designed to be readily mounted on a standard shelf 12 and to feed a row of cans to the front of the shelf each time a can is removed from the front of the shelf. The apparatus 10 is illustrated in detail in FIGS. 3 to 7, and basically comprises an elongate track 25 for mounting between the rear and front edges of the shelf, a pusher member 26 slidably mounted for movement along the track 25, and a spring mechanism 28 for pulling the pusher member 26 along the track. A row of products such as cans 14 is placed on the track 25 in front of the pusher member, as best illustrated in FIGS. 1 and 2, such that the cans are urged to the front end of the shelf by the pusher member.

Figure 7:
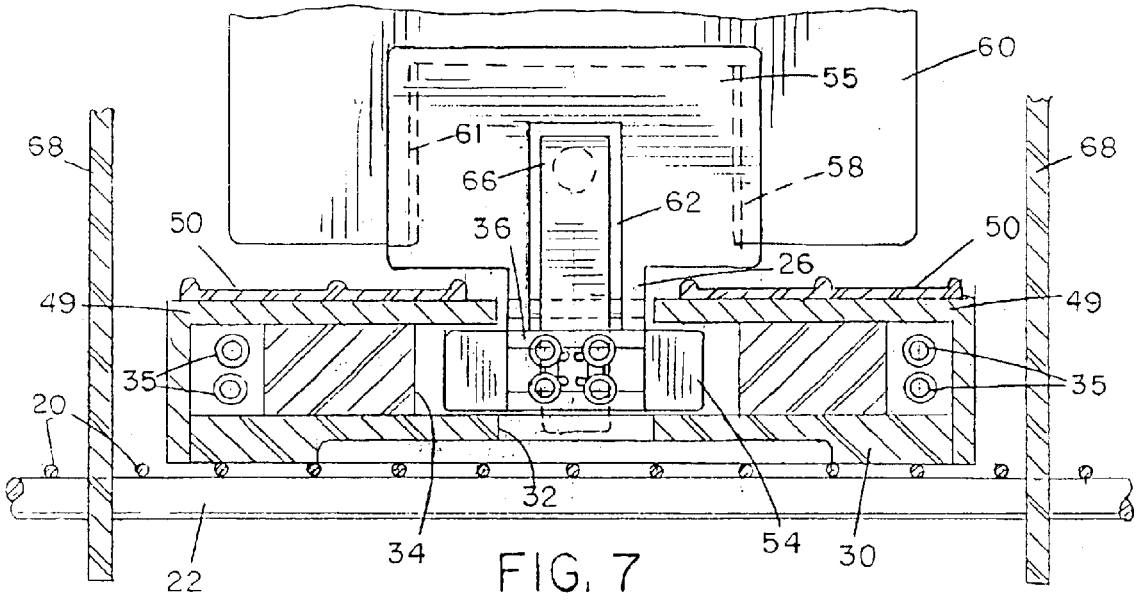
FIG. 7 is an enlarged sectional view taken on line 7—7 of FIG. 5.

The track 25 comprises a base member 30 having a series of spaced openings 32 and a pair of opposing side rails 34 between which the pusher member 26 is slidably mounted, as best illustrated in FIG. 7. The spring mechanism 28 comprises one or more elongate springs 35 each secured to the front end 36 of the pusher member at one end. A pair of rollers 38 each having at least two circumferential grooves 40 are rotatably mounted adjacent the forward end 42 of the track, and springs 35 extend from the pusher member around each of the rollers 38 and then back along opposite sides of the track towards the rear end of the track, with their rear ends anchored at anchors 44. Zero, one, or two springs may be extended from the pusher member around each roller 38, depending on the amount of spring force required to advance the pusher member. The drawings illustrate a total of four springs, two on each side of the track. The springs 35 may be linear tension, rope type springs. However, any alternative elongate, resilient members may be used in place of springs 35, such as bungee cords or the like.

Figure 3:
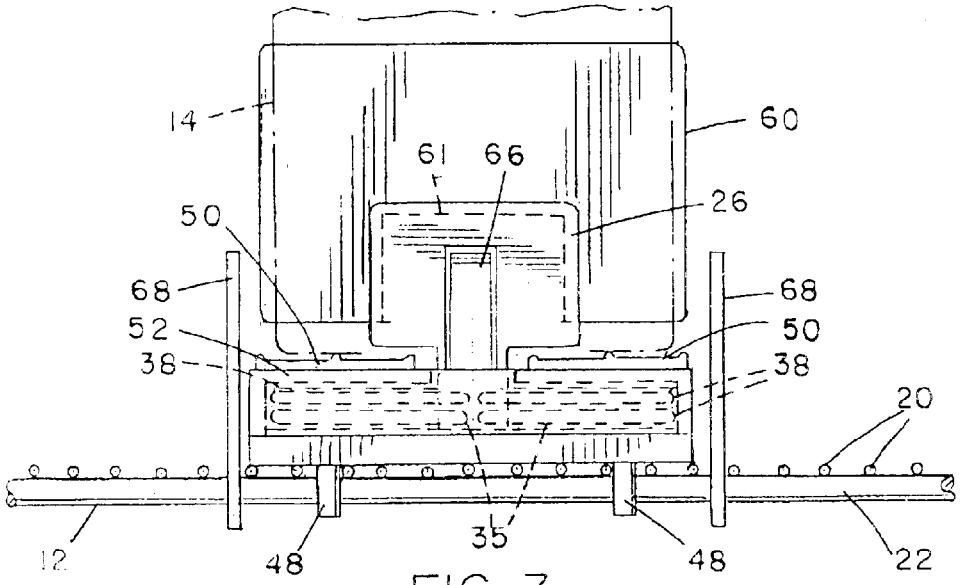
FIG. 3 is an enlarged view taken on line 3—3 of FIG. 1.

The track is mounted on the shelf via hooks 45 at its rear end which engage under a rear cross bar 46 of the shelf, as illustrated in FIGS. 1 and 2, and by posts 48 at the forward end which extend downwardly between the shelf wires 20, as illustrated in FIG. 3. Where the shelf is a solid panel, holes will be provided in the panel for receiving hooks 45 and posts 48. A pair of generally L-shaped side plates 49 are secured over the opposite sides of the track so as to cover and protect the springs and hold the pusher member on the track, as illustrated in FIG. 7. Slide rails 50 are secured on top of the side plates 49 for smooth sliding movement of the product 14 along the track. A front cover member 52 is secured over the front end of the track over the rollers. The track may alternatively be made in one piece by extrusion or the like.

Figure 4:
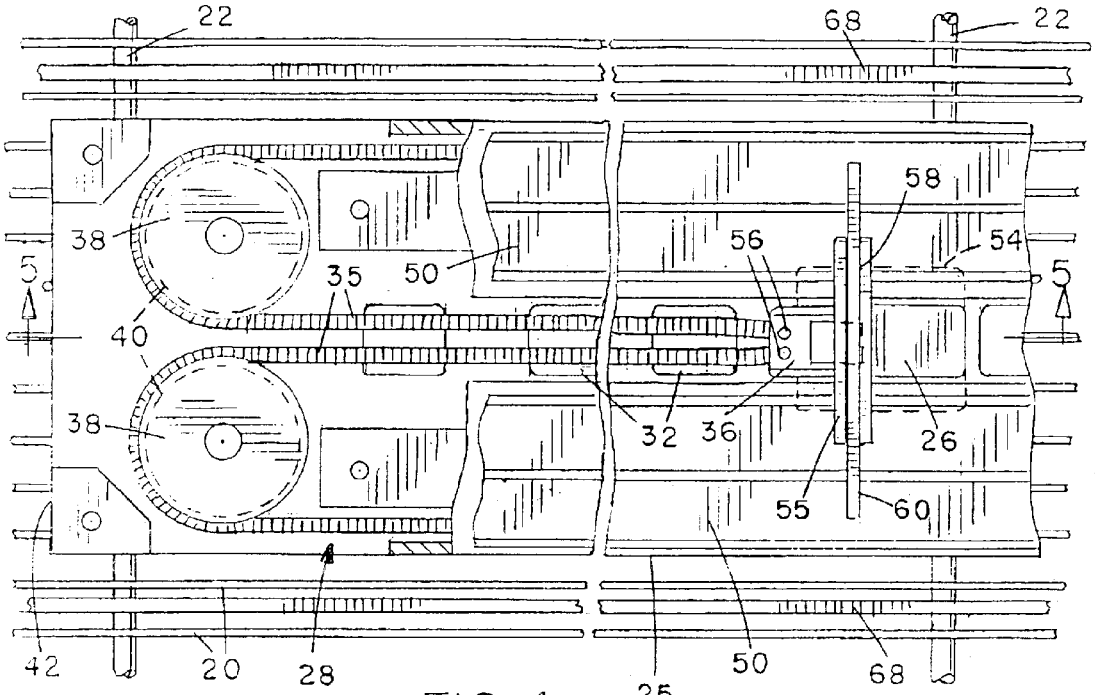
FIG. 4 is an enlarged top view of the upper portion of the shelf with some elements cut away.
Figure 5:
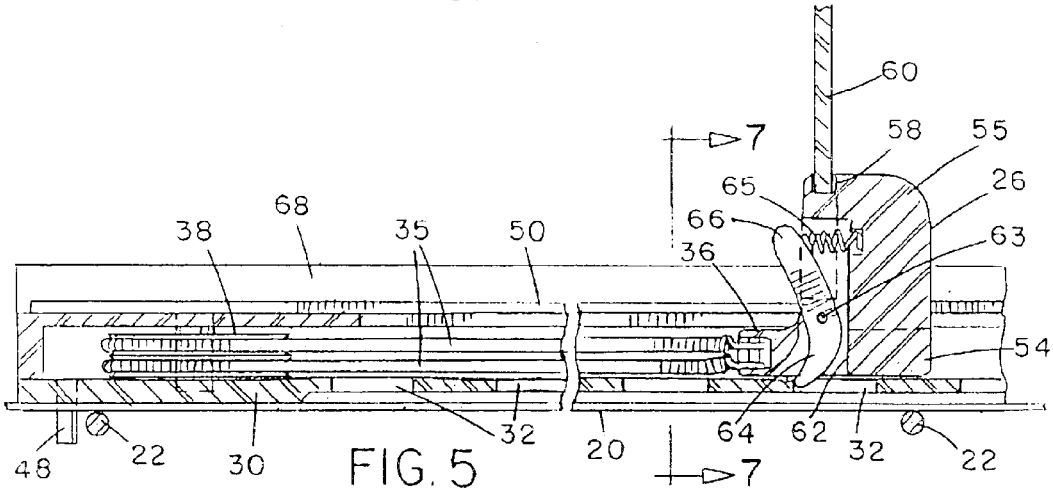
FIG. 5 is a sectional view taken on line 5—5 of FIG. 4, with the pusher member unloaded and latched in place.
Figure 6:
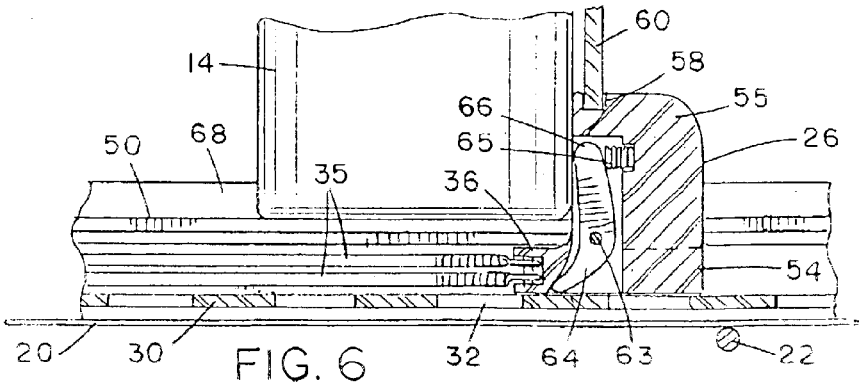
FIG. 6 is a similar view with the pusher member loaded and released to move.

The pusher member 26 will now be described in more detail, with reference to FIGS. 4 to 7. Member 26 comprises a base, slide portion 54 which slides between rails 34, and an upwardly projecting portion 55 which projects upwardly through the slot between the two side plates 49. The base portion 54 has openings 56 at the forward end 36 for receiving suitable releasable fasteners for holding the ends of the springs 35, as best illustrated in FIGS. 4 to 6. The upwardly projecting portion 55 has an outer, mounting groover 58 over which an enlarged pusher plate 60 can be engaged. Different pusher plates 60 of various shapes and sizes may be provided for use with products of different shapes and sizes. Each plate has a central notch or rectangular indent 61 in its lower edge for engaging over the groove 58. The pusher plates 60 are preferably of transparent material, such as transparent plastic.

The portion 55 of the pusher member also has a forwardly facing, central indent or slot 62 in which a hook or latch element 64 is pivotally mounted on pivot 63. The latch element 64 is biased by spring 65 inside the slot 62 into the downwardly projecting position illustrated in FIG. 5, in which the lower, hooked end of the element 64 engages in one of the openings 32 in the base of the track, so that the pusher member is held in position. The upper end part 66 of the element 64 projects forwardly out of the slot 62 when the latch element is in the latched position, as indicated in FIG. 5. Element 64 is rotatable from the latched position of FIG. 5 into the raised, released position of FIG. 6 by pushing the upper part 66 of the element 64 back into the slot 62, rotating it in a clockwise direction about pivot 63. The latch element 64 will automatically be retracted into the released position by the force of the rearmost can or product 14 of a row of products acting against hook member 64. Although the latch element projects through an opening in the track to lock the pusher member in the illustrated embodiment, it may alternatively be arranged to engage other latch formations in the track, such as shoulders or teeth. Additionally, instead of having a forwardly projecting portion for engagement by the rearmost item in a loaded row, the latch may have an upwardly projecting portion which is depressed by a can or the like to release the latch.

Figure 8:
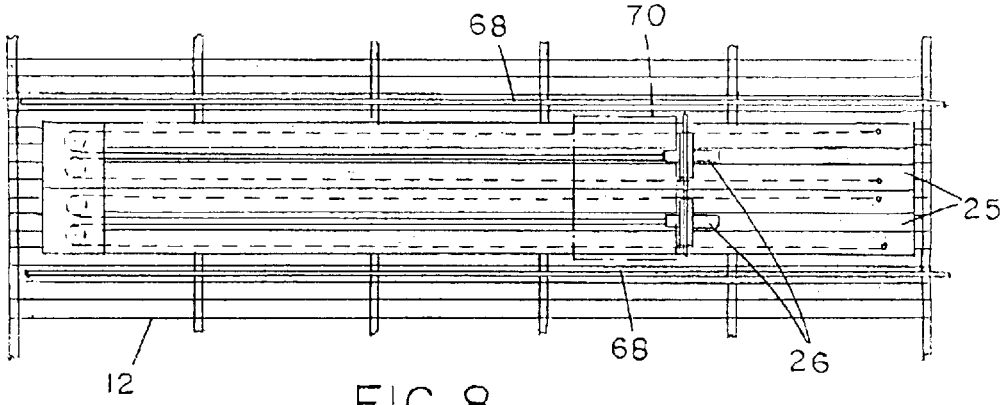
FIG. 8 is a top view showing dual track units.

Operation of the feed apparatus of FIGS. 1 to 7 and 9 will now be described in more detail. A series of tracks 25 will first be mounted side-by-side across the width of a shelf, using the hooks 45 and posts 48 to locate each track. Dividers 68 will be placed between each adjacent pair of tracks to separate product on one track from product in the adjacent tracks. The dividers may be divider plates as described in my co-pending application entitled "Divider Apparatus for Separating Product Rows on Shelves", filed on even date herewith, or any suitable divider devices. The individual tracks 25 of FIGS. 1 to 7 are designed for mounting a row of products of individual soda can size. Clearly, they may be made in different sizes for different size products. However, rather than having tracks of varying sizes, if products of varying widths are to be displayed on a shelf, two or more tracks may be mounted side-by-side with no intervening divider between the tracks, and a single row of larger products 70, such as six packs of soda, boxes containing products such as pizza or the like, or gallon-size bottles, may be supported on the track in front of the two pusher members 26, as indicated in FIG. 8. This avoids the need for a track or pusher member of different size for each different size product. Instead, a single basic track and pusher member may be provided, with the installer deciding how many tracks are needed for advancing each row of products, and positioning the dividing walls appropriately on each shelf outside the outermost tracks, depending on the product width. Two tracks will be sufficient for six packs of soda and the like or gallon-size bottles of water, milk, juice or the like, while three tracks may be used side by side to advance a row of pizza boxes, 12 pack boxes of soda, and the like.

The number of springs 35 used per track may be readily adjusted based on the size and weight of the product to be advanced, and the number of tracks used. If one track is used, the installer may select 1, 2, 3 or 4 springs, i.e. one on one side only, one on each side, two on one side and one on the other, or two on each side. The number of springs needed will also depend on whether the shelf is oriented horizontally or inclined upwardly. Thus, for example, an arrangement with two side by side tracks for advancing 2 liter bottles of soda or the like will require one spring per pusher for level track, and two springs per pusher for an upwardly inclined track. If two tracks are arranged side by side for advancing heavier, gallon bottles of water or other liquids, two springs per pusher will be required for level track, and four springs per pusher for upwardly inclined track. With this arrangement, rather than having to provide different springs having different spring forces for advancing different products or for accommodating different shelf tilts, a greater or lesser number of identical springs can instead be used. This is a much more inexpensive and convenient arrangement for varying the spring force.

Once all the tracks have been positioned on a shelf and divider walls have been appropriately positioned, each track, or adjacent tracks where more than one is needed, is filled with a row of products to be advanced. This is done by first retracting the pusher member 26 to the rear end of the track, and then releasing it so that the latch 64 is urged into the latched position illustrated in FIG. 5, holding the pusher member in position. This avoids the need for the operator to physically hold the pusher member while the track is loaded, and avoids the risk of the pusher member flying along to the front end of the track if accidentally released while the track is empty. The operator then fills the track with product, such as cans 14 or any other types of products typically dispensed from grocery store refrigerated shelving. The pressure of the rearmost product on the latch member 64 will release it from the latched position into the position of FIG. 6, allowing product feed. However, the forward product in the row will be restrained by the stop or wall at the front end of the shelf, so no product advance will occur until a customer takes the front product off the shelf. At this point, the springs 35 will advance the row of products until the front product reaches the stop. When the last product is removed, the latch member 64 will again engage in an underlying opening 32 in the track, preventing further advance.

After a track is completely empty, the operator can readily reload it in the same manner, pushing the pusher member back to the rear of the track and letting the latch member engage in a track opening to lock the pusher member in position during shelf loading. By hooking the rear end of the pusher track under the back wire or support rod of the shelf, the risk of the pusher track being lifted up over the back wire by the pushing force is avoided. The rear hooks and forward posts on the tracks also locate and hold the track in the desired transverse position on the shelf.

The apparatus of this invention can be arranged to feed a variety of different products consistently to the front edge of a shelf for ready dispensing to customers. The feed apparatus is relatively simple and easy to install on a shelf, and can be readily adapted to advance different size, shape, and weight containers with only a few basic components. The pusher member has a latch which automatically engages in the track if the track is not loaded with product. This locks the pusher in place while loading, leaving the operator with both hands free to load the track, and also avoids the risk of the pusher flying down the track at high speed if accidentally released while it is being pushed back to the rear of the track.

Although an exemplary embodiment of the invention has been described above by way of example only, it will be understood by those skilled in the field that modifications may be made to the disclosed embodiment without departing from the scope of the invention, which is defined by the appended claims.

I claim:

1. A product feed apparatus for feeding products or items arranged in rows on a shelf to the front edge of the shelf, comprising:

an elongate track adapted to be mounted on a rectangular shelf unit so as to extend from a rear edge to a front edge of the shelf unit, the track having opposite sides, a forward end, and a rear end;

a pusher member slidably mounted in the track for movement from the rear edge to the front edge of the track, the pusher member having a front end, a pusher plate on the pusher member for engaging a rear surface of the rearmost product of a row of products supported on the track; and a biasing assembly for biasing the pusher member towards the front edge of the track, the biasing assembly comprising a plurality of identical elongate resilient biasing elements for releasably securing between the front end of the pusher member and the track so as to advance the pusher member along the track, whereby an installer may select a predetermined number of biasing elements to secure between the pusher member and track dependent on the size and weight of the products to be advanced;

the biasing assembly further comprising a plurality of first anchors at the front end of the pusher member, a plurality of second anchors spaced from the front end of the track, including at least one second anchor on each side of the track, and a pair of rollers mounted side by side adjacent the front edge of the track, each roller having at least two circumferential grooves, the selected biasing elements each having a first end releasably secured to a first anchor, the biasing element extending from the pusher member around a respective one of the rollers and then rearwardly along a respective side of the track back towards the rear end of the track, and having a second end releasably secured to a respective second anchor, whereby an operator can adjust the spring force applied to the pusher member by varying the number of biasing elements in the biasing assembly by selectively extending a greater or lesser number of biasing elements from the pusher member, around a respective roller, and up to a respective second anchor.

2. The apparatus as claimed in claim 1, wherein the biasing elements are springs.

3. The apparatus as claimed in claim 2, wherein the springs are linear tension, rope springs.

4. A product feed apparatus for feeding products or items arranged in rows on a shelf to the front edge of the shelf, comprising:

an elongate track adapted to be mounted on a rectangular shelf unit so as to extend from a rear edge to a front edge of the shelf unit, the track having opposite sides, a forward end, and a rear end;

a pusher member slidably mounted in the track for movement from the rear edge to the front edge of the track, the pusher member having a front end;

a pusher plate on the pusher member for engaging a rear surface of the rearmost product of a row of products supported on the track;

a biasing assembly for biasing the pusher member towards the front edge of the track, the biasing assembly comprising a plurality of identical elongate resilient biasing elements for releasably securing between the front end of the pusher member and the track so as to advance the pusher member along the track, whereby an installer may select a predetermined number of biasing elements to secure between the pusher member and track dependent on the size and weight of the products to be advanced; and a latch element pivotally mounted on the pusher member, the latch element being movable between a locking position and a retracted position, the track having latch formations for engaging the latch element in the operative position to prevent movement of the pusher member.

5. The apparatus as claimed in claim 4, wherein the latch element is movable between a raised position and a downwardly extending, locking position, a biasing member biasing the latch element into the locking position, and the track having a series of holes along its length comprising said latch formations, and the latch element engaging in one of the holes when in the locking position.

6. The apparatus as claimed in claim 4, wherein the latch element has a projecting portion which projects from the pusher member when the element is in the locking position, whereby products loaded in front of the pusher member will force the projecting portion inwardly, rotating the latch element into the raised, released position.

7. The apparatus as claimed in claim 4, including a plurality of different pusher plates of different sizes for engaging different products, the pusher plates being formed separately from the pusher member, and a selected pusher plate being releasably engageable with the pusher member.

8. The apparatus as claimed in claim 4, including a pair of dividers for releasably mounting on a shelf on opposite sides of the track to retain a row of products on the track.

9. A product feed apparatus for feeding products or items arranged in rows on a shelf to the front edge of the shelf, comprising:

an elongate track adapted to be mounted on a rectangular shelf unit so as to extend from a rear edge to a front edge of the shelf unit, the track having opposite sides, a forward end, and a rear end;

a pusher member slidably mounted in the track for movement from the rear edge to the front edge of the track, the pusher member having a front end;

a pusher plate on the pusher member for engaging a rear surface of the rearmost product of a row of products supported on the track;

a biasing assembly for biasing the pusher member towards the front edge of the track, the biasing assembly comprising a plurality of identical elongate resilient biasing elements for releasably securing between the front end of the pusher member and the track so as to advance the pusher member along the track, whereby an installer may select a predetermined number o biasing elements to secure between the pusher member and track dependent on the size and weight of the products to be advanced; and the track having a base with a lower face for resting on top of a shelf unit, the rear end of the track having at least two rearwardly and downwardly projecting hooks for engagement under a rear cross member of the shelf unit to retain the track on the shelf unit.

10. The apparatus as claimed in claim 9, wherein the track has at least two locating posts projecting downwardly from the lower face of the base for engagement between respective pairs of adjacent wires of the shelf unit.

11. A shelf apparatus for advancing a plurality of side-by-side rows of product from a rear edge to a front edge of a shelf, the apparatus comprising:

a shelf having a front edge, a rear edge, and opposite sides;

a plurality of elongate product feed units mounted side-by-side across the width of the shelf and each extending from the rear edge to the front edge of the shelf;

each feed unit comprising an elongate track mounted on a rectangular shelf unit so as to extend from the rear edge to the front edge of the shelf unit, the track having opposite sides, a forward end, and a rear end, a pusher member slidably mounted in the track for movement from the rear edge to the front edge of the track the pusher member having a front end, a pusher plate on the pusher member for engaging a rear surface of the rearmost product of a row of products supported on the track, and a biasing assembly for biasing the pusher member towards the front edge of the track;

a plurality of dividers releasably mounted on the shelf between at least some adjacent pairs of tracks to form a support for a row of items mounted in front of the pusher member on a respective track, whereby dividers mounted on opposite sides of a single track form a single width support for a row of items of a first size, dividers mounted on the outer sides of an adjacent pair of two, side-by-side tracks with no divider between the tracks forms a double width track support for a row of items of a second, larger size, and dividers mounted on the outer sides only of the outermost tracks of three side-by-side tracks with no divider between the tracks forms a triple width track support for a row of items of a third, larger size than the second size; and the biasing assembly comprising a pair of rollers mounted side by side adjacent the front edge of the respective track, each roller having at least two circumferential grooves, and a plurality of elongate, resilient biasing elements each having a first end releasably secured to the front end of the pusher member, and extending from the pusher member around a respective one of the rollers and then rearwardly along a respective side of the track back towards the rear end of the track, a plurality of anchors spaced from the front end of the track, including at least one anchor on each side of the track, and each biasing element having a second end releasably secured to a respective anchor, each biasing element engaging in a respective groove in a roller;

whereby an operator can adjust the spring force applied to the pusher member by varying the number of biasing elements in the biasing assembly by selectively extending a greater or lesser number of biasing elements from the pusher member, around a respective roller, and up to a respective anchor.

12. The apparatus as claimed in claim 11, wherein the biasing elements are identical springs.

13. The apparatus as claimed in claim 12, wherein the springs are linear tension, rope springs.

14. A shelf apparatus for advancing a plurality of side-by-side rows of product from a rear edge to a front edge of a shelf, the apparatus comprising:

a shelf having a front edge, a rear edge, and opposite sides;

a plurality of elongate product feed units mounted side-by-side across the width of the shelf and each extending from the rear edge to the front edge of the shelf;

each feed unit comprising an elongate track mounted on a rectangular shelf unit so as to extend from the rear edge to the front edge of the shelf unit, the track having opposite sides, a forward end, and a rear end, a pusher member slidably mounted in the track for movement from the rear edge to the front edge of the track, the pusher member having a front end, a pusher plate on the pusher member for engaging a rear surface of the rearmost product of a row of products supported on the track, and a biasing assembly for biasing the pusher member towards the front edge of the track;

a plurality of dividers releasably mounted on the shelf between at least some adjacent pairs of tracks to form a support for a row of items mounted in front of the pusher member on a respective track, whereby dividers mounted on opposite sides of a single track form a single width support for a row of items by-side tracks with no divider between the tracks forms a double width track support for a row of items of a second larger size and dividers mounted on the outer sides only of the outermost tracks of three side-by-side tracks with no divider between the tracks forms a triple width track support for a row of items of a third larger size than the second size; and a latch element pivotally mounted on each pusher member, the latch element being movable between a locking position in which it engages in the track to lock the pusher member against movement, and a released position in which the pusher member is free to move.

15. The apparatus as claimed in claim 14, including biasing means for biasing the latch element into the locking position.

16. The apparatus as claimed in claim 14, wherein the track has a series of holes along its length, and the latch element extending downwardly in said locking position to engage in one of the holes when in the locking position to prevent movement of the pusher member along the track.

17. The apparatus as claimed in claim 14, wherein the latch element has a projecting portion which projects outwardly from the pusher member when the element is in the locking position, whereby products loaded in front of the pusher member will force the projecting portion inwardly, rotating the latch element into the released position.

18. The apparatus as claimed in claim 14, including a plurality of different pusher plates of different sizes for engaging different products, the pusher plates being formed separately from the pusher member, and a selected pusher plate being releasably engageable with each pusher member.

19. A method of feeding a row of products towards the front edge of a shelf, comprising the steps of:

mounting at least one elongate track on a shelf so as to extend from the rear edge to the front edge of the shelf;

retracting a spring-loaded pusher member slidably mounted on the track to a rear end of the track;

locking the pusher member in the retracted position with a latch member against a spring force urging it towards the front edge of the shelf;

loading a row of products onto the track in front of the pusher member, the latch member being automatically released by the loading of products; and biasing the pusher member towards the front edge of the shelf, whereby the row of products is advanced to the front edge each time a product is removed from the front of the row.

20. The method as claimed in claim 19, including the step of varying the number of springs attached to the pusher member so as to change the biasing force on the pusher member dependent on the size and weight of product to be advanced.

21. The method as claimed in claim 19, including the steps of mounting two or more tracks side by side and loading a single row of larger products onto the adjacent tracks, with the pusher members on all the tracks acting against the rearmost product in the row.

22. A product feed apparatus for feeding products or items arranged in rows on a shelf to the front edge of the shelf, comprising:

an elongate track adapted to be mounted on a rectangular shelf unit so as to extend from a rear edge to a front edge of the shelf unit, the track having a base, opposite sides, a forward end, and a rear end;

the base of the track having a series of latch formations along at least the majority of its length;

a pusher member slidably mounted in the track for movement from the rear edge to the front edge of the track, the pusher member having a front end;

a pusher plate on the pusher member for engaging a rear surface of the rearmost product of a row of products supported on the track;

a biasing assembly linked to the pusher member for biasing the pusher member towards the front edge of the track; and a latch element movably mounted on the pusher member, the latch element being movable between a released position and a locking position, a biasing member urging the latch element into the locking position, and the latch element engaging in one of the latch formations in the track when in the locking position to prevent movement of the latch element along the track.

23. The apparatus as claimed in claim 22, wherein the latch element has a projecting portion which projects outwardly from the pusher member when the element is in the locking position, whereby products loaded in front of the pusher member will force the forwardly projecting portion inwardly, rotating the latch element into the released position.

* * * * *